United States Patent [19]

Heritage

[11] 4,262,980

[45] Apr. 21, 1981

[54] LAMP HOLDER

[75] Inventor: Robert Heritage, London, England

[73] Assignee: Rotaflex Limited, London, England

[21] Appl. No.: 33,802

[22] Filed: Apr. 26, 1979

[30] Foreign Application Priority Data

Apr. 28, 1978 [GB] United Kingdom ..... 17073/78
May 31, 1978 [GB] United Kingdom ..... 17073/78

[51] Int. Cl.[3] ..... F21M 3/18; F21V 21/30

[52] U.S. Cl. ..... 339/1 L; 339/206 L; 339/210 T; 362/371

[58] Field of Search ..... 339/1 L, 2 L, 2 R, 4, 339/22 B, 138, 141, 206 L, 207 R, 209, 210 T, 210 R, 210 M; 403/42, 88, 309–312; 362/199, 404, 406, 424, 371, 418, 419, 426, 429, 430

[56] References Cited

U.S. PATENT DOCUMENTS 4,108,523 8/1978 Bolis ..... 339/22 B

FOREIGN PATENT DOCUMENTS 1489381 5/1969 Fed. Rep. of Germany ..... 339/206 L
7804784 11/1978 Netherlands ..... 339/210 T
1325427 8/1973 United Kingdom ..... 362/371

*Primary Examiner*—Eugene F. Desmond
*Attorney, Agent, or Firm*—Arthur B. Colvin

[57] ABSTRACT

A lamp holder comprising an insulated casing formed in two halves between and by which are located and clamped a mounting socket to receive the base or cap of a lamp. A pair of contacts is associated with said socket and a mounting stirrup cooperates with the casing to permit pivotal movement of the casing relative to the stirrup about an axis transverse and preferably perpendicular to the axis of the mounting socket.

3 Claims, 3 Drawing Figures

LAMP HOLDER

Lamp holders for use in light fittings such as spotlights and the like, conventionally comprise an unitary insulated body, commonly of ceramic material, in which are mounted the essential elements of the holder, that is a mounting boss to receive the base (or cap) of a lamp, and the electrical contacts which engage the base of the lamp. Such lampholders are then assembled with a support body, such as a spotlight or flood-light housing, which is in turn mounted by an external support.

It is frequently desired to mount a completed fitting of this general form for rotation about one or more axes for directing light from the fitting in desired directions.

The present invention provides a lamp holder which is particularly well suited to compact and simple construction, in which the lamp holder requires no external housing and is directly mounted for rotational movement about one or two axes.

In a presently preferred constructional form of the invention, the lamp holder comprises an insulated casing formed in two halves between and by which are located and clamped a mounting socket to receive the base or cap of a lamp. A pair of contacts is associated with said socket and a mounting stirrup co-operates with the casing to permit pivotal movement of the casing relative to the stirrup about an axis transverse and preferably perpendicular to the axis of the mounting socket.

This form of lamp holder is described in detail below by way of example, with reference to the accompanying drawings in which.

Figure 1:
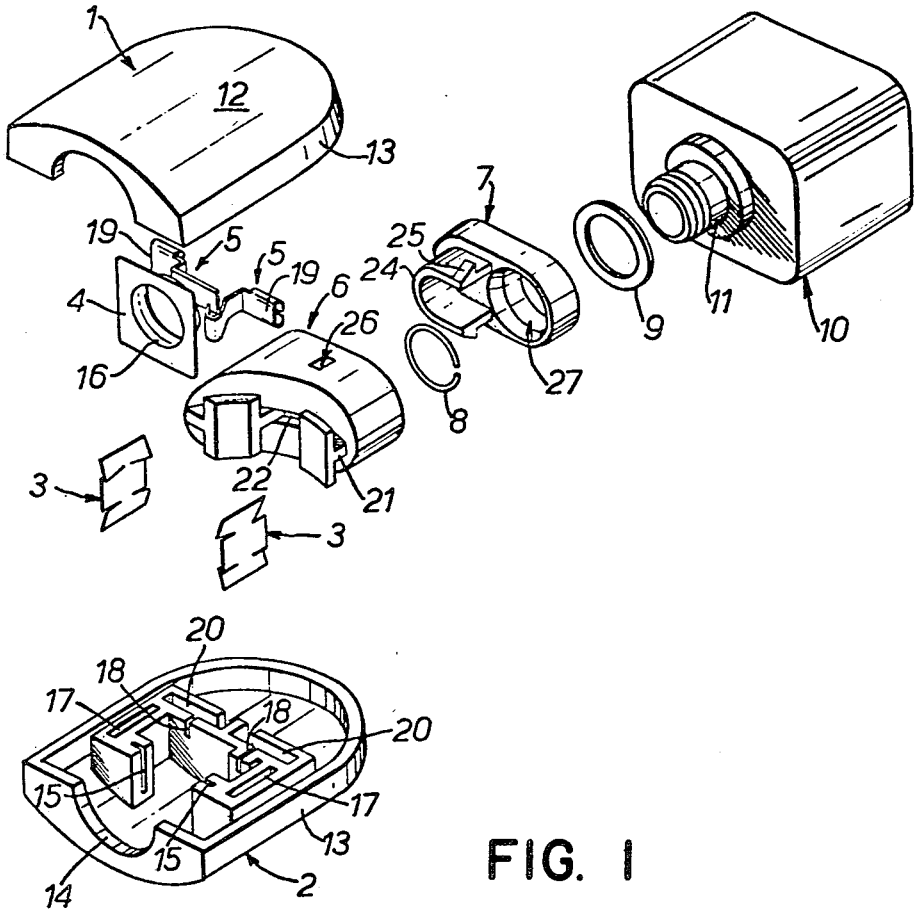
FIG. 1 is an exploded perspective view of the lampholder.

The lampholder shown in the drawings comprises a pair of insulated casing halves 1, 2, a pair of securing clips 3, a mounting socket 4, a pair of contacts 5, a mounting stirrup 6 with an end cap 7, circlip 8, a spring washer 9 and a track adaptor 10 having a mounting boss 11.

The two casing halves 1, 2 are identically formed of moulded plastics, each with a main side wall 12 and a peripheral wall 13 formed at one end of the casing half with a semi-circular recess 14 to fit around the neck of the lamp.

The casing halves are each formed internally with a number of slots and pockets to receive and locate other components. Slots 15 locate edges of the socket 4, which is formed of sheet material with an integral screw threaded socket portion 16. Pockets 17 receive the securing clips 3, which are of springy sheet material formed with tangs to engage securely in the pockets.

The contacts 5 each have contact portions positioned behind the socket 4, intermediate portions engaged in slots 18 and terminal connector portions 19 located in pockets 20.

The mounting stirrup 6 comprises a hollow casing the forward end wall of which is of concave part-cylindrical form to match the profile of the rear portion of the casing halves and is formed with a T-section flange 21 interrupted between its ends to either side of a slot 22 through the concave wall. The mounting portion of the stirrup thus consists effectively of a circularly arcuate track of double channel, of H cross-section for receiving and guiding the semi-circular portions of the respective walls 13 of the casing halves.

The stirrup 6 also includes the end cap 7 having a part tubular boss 24 with hooks 25 which make snap fitting engagement with recesses 26 of the main casing of the stirrup when the cap is assembled with the casing. The end cap 7 also has a counterbored hole 27 to receive the mounting boss 11 of the adaptor.

The parts are assembled by locating the components 3, 4 and 5 in their respective slots and pockets in one casing half, the connector portions 19 of the contacts first having the respective conductors of a flex secured to them. The flex is fed through the stirrup slot 22 and the arcuate track portion of the stirrup is engaged over the arcuate end wall 13. The second casing half is then brought down and closed over the various components. The clips 3 effect a permanent retention of the parts. The raised internal portions of the casing halves define the joint plane in the assembled casing and thus set the desired spacing of the edges of the walls 13 to suit the mounting portion of the stirrup.

The spring washer 9 and stirrup end cap 7 are threaded over the mounting boss 11 and secured to it by the circlip 8, which retains the end cap to the boss axially but permits its rotation about the axis of the boss.

The flex is taken through the boss and connected to the terminals of the track adaptor 10, which may be of known form in itself for use with a continuous outlet electrical supply track.

The lighting fitting is now complete and ready to receive a lamp whose base is screwed into the mounting socket 4 and engages the contacts 5. The casing is rotatable, relative to the mounting stirrup 6, about a transverse axis perpendicular to the axes of the lamp, and the stirrup is in turn rotatable about the mounting boss 11, whose axis is perpendicular to the said transverse axis, so that the lamp holder is rotatable about two mutually transverse axes relative to the adaptor.

Of course, it is not essential to employ a track adapter as the external support, but its use does provide a particularly convenient combination.

The casing of the lampholder, will, of course, need to have resistance to high temperatures in use of the fittings and may if desired or found necessary, be formed with cooling passages to permit a flow of air over the base of the lamp. The lampholder as shown is, of course, designed to receive a standard lamp having a screw base, but by altering the design of the mounting socket, the lampholder could receive lamps having bayonet fitting bases push-in caps.

Figure 2:
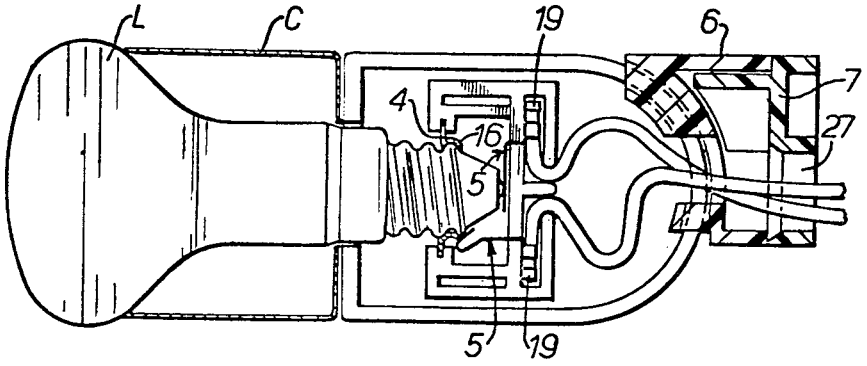
FIG. 2 is a plan view of the lampholder, with one casing half and some details omitted for clarity.
Figure 3:
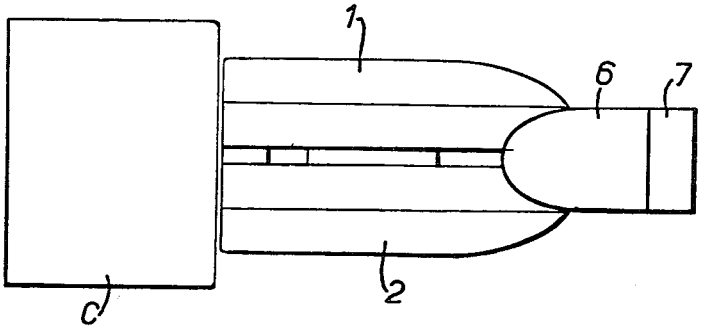
FIG. 3 is a side elevation of the lampholder.

In FIG. 2, a lamp L is shown engaged in the lampholder, trapping a loose, external cowl C, which could be replaced by a reflector or other accessory. The cowl, but not the lamp is also seen in FIG. 3.

The lampholder casing may as indicated be of high temperature resistant moulded plastics, or for example of ceramic material.

Having thus described my invention, what I claim as new and desire to secure by letters patent of the United States is:

1. A lampholder comprising an insulated casing having an end adapted to receive a lamp base therethrough, said casing being formed in two secured insulated halves, a mounting socket located and clamped between said halves inward of said casing end to receive and mount a lamp base therein, a pair of contacts located and clamped between said halves independently of said mounting socket and inwardly thereof relative to said end, said contacts being associated with the socket for engagement by a socket mounted lamp base, and a mounting stirrup directly mounting the casing to permit pivotal movement of the casing relative to the stirrup about a transverse axis perpendicular to the axis of the mounting socket, said casing halves having opposed arcuate edge portions, said stirrup having a guide part received and slidably retained between the opposed edge portions of the casing halves with and independent of said socket and said contacts, said guide part cooperating with said edge portions to permit said casing halves, with the clamped mounting socket and contacts, to slide around the said guide part, whereby said casing halves directly receive therebetween and constitute the sole means for retaining said mounting socket, said contacts, and said stirrup.

2. A lampholder according to claim 1, wherein the guide part of the stirrup is interrupted between its ends to provide a gap through which a conductor cable is taken through the stirrup.

3. A lampholder according to claim 1, in which the said guide part is of H-section.

* * * * *